United States Patent [19]

Movshovich et al.

[11] 4,055,039

[45] Oct. 25, 1977

[54] APPARATUS FOR OBTAINING SELF-TWISTED PRODUCT

[76] Inventors: Pavel Mikhailovich Movshovich, Pechatnikov pereulok, 3, kv. 8; Gennady Konstantinovich Maximov, Kaspiiskaya ulitsa, 20, korpus, 3, kv. 137, both of Moscow; Viktor Pavlovich Khavkin, Khimki, ulitsa Valutina, 11, kv. 4, Moskovskaya oblast; Lev Nikolaevich Ivanov, Kotelnicheskaya naberezhnaya 25/8, kv. 74, Moscow; Natalya Borisovna Babushkina, Chasovaya ulitsa, 5b, kv. 15, Moscow; Vladimir Konstantinovich Afanasiev, Galyanovsky proezd, 4a, kv. 219, Moscow; Tamara Nikolaevna Kudryavtseva, Davydkovskaya ulitsa, 6, kv. 5, Moscow; Sergei Vladimirovich Nezelenov, Kineshemskoe shosse, 8a, kv. 6, Kostroma, all of U.S.S.R.

[21] Appl. No.: 707,212

[22] Filed: July 21, 1976

[30] Foreign Application Priority Data

July 29, 1975 U.S.S.R. ..... 2164973

[51] Int. Cl.[2] ..... D02G 3/28

[52] U.S. Cl. ..... 57/34 AT; 28/271; 57/77.3; 57/157 F

[58] Field of Search ..... 57/34 AT, 34 B, 157 F, 57/77.3, 140 R; 28/1.4, 72.12

[56] References Cited

U.S. PATENT DOCUMENTS

| | | | |
|---|---|---|---|
| 2,990,671 | 7/1961 | Bunting, Jr. et al. | 57/157 F X |
| 3,279,164 | 10/1966 | Breen et al. | 57/34 AT X |
| 3,775,955 | 12/1973 | Shah | 57/34 AT |
| 3,775,958 | 12/1973 | Lloyd et al. | 57/157 F X |

FOREIGN PATENT DOCUMENTS

| | | | |
|---|---|---|---|
| 1,047,503 | 11/1966 | United Kingdom | 57/157 F |

*Primary Examiner*—John Petrakes
*Attorney, Agent, or Firm*—Steinberg & Blake

[57] ABSTRACT

The apparatus for obtaining a self-twisted product from at least two filamentary strands relates to spinning equipment. The apparatus includes a mechanism for continuously feeding the strands, swirl chambers having each jet passages producing air swirls of opposite directions within these chambers and thus effecting the twisting of the strands, an arrangement for supplying air alternatingly into these jet passages, a device for uniting or plying the strands issuing from the chambers and a mechanism for winding the final product. In each swirl chamber, the jet passages are displaced relative to one another longitudinally of the chamber. In adjacent swirl chambers, the jet passages producing the air swirls of the same direction are arranged to that one of them is situated at the inlet end of its respective chamber, while the other one is situated at the outlet end of its chamber. In this way clogging of the jet passages is precluded, and the strength of the final product is increased.

7 Claims, 4 Drawing Figures

APPARATUS FOR OBTAINING SELF-TWISTED PRODUCT

The invention relates to spinning equipment and, more particularly, it relates to apparatus for obtaining a self-twisted product, e.g. yarn or roving, from at least two filamentary strands, e.g. of a fibrous material.

There are already known apparatus for obtaining a self-twisted product by effecting alternating twisting of the strands. The apparatus includes a mechanism for continuously feeding the strands, swirl chambers, a device controlling the operation of the swirl chambers, and a delivery mechanism. The strands of a fibrous material are fed into the swirl chambers wherein a pulsating air swirl is produced. This swirl acts upon the strands and produces therein portions with the twist in alternating directions. Upon the strands having been united or plied, they untwist about one another, yielding the self-twisted product.

In this known apparatus, the chambers are so made that a swirl of a single direction is created therein. Consequently, within the period of the action of the swirl upon the strand, the latter acquires a twist of one degree of intensity or magnitude, whereas in the absence of the swirl, i.e. in the absence of the torque, the strand develops a twist of a different intensity. Furthermore, the above-mentioned known structure yields different lengths of portions of the strand, devoid of the twist, meaning the portions which correspond to the transitions from the active semi-cycle to the passive one and vice versa.

There is also known a method of obtaining a self-twisted product which is performed by an apparatus including a mechanism for continuously feeding the strands, swirl chambers, a device for supplying air into the jet passages of the swirl chambers, a device for uniting or plying the strands and a mechanism for winding the final product. The jet passages are adapted to alternately create within the chambers air swirls of opposite directions, effecting the twisting of the strands, the jet passages being situated within a respective chamber in a single plane. This results in that dust and oil particles are blown into the passage which is not operating at a given moment. Consequently, the jet passages become clogged, which sharply reduces the twisting capacity of the swirl chamber. In practice, the operability of such swirl chambers, for instance, in the production of worsted yarn, lasts for about only 12 to 18 hours, whereafter the chambers have to be replaced and cleaned.

It is an object of the present invention to provide an apparatus for obtaining a self-twisted product from at least two strands, wherein the swirl chambers should be of a structure precluding the clogging of the jet passages of the swirl chambers, with the stability of the process performed within the chambers enhanced and the quality of the product improved.

With this and other objects in view, the present invention resides in an apparatus for obtaining a self-twisted product from at least two strands, comprising a mechanism for continuously feeding the strands into the swirl chambers having therein jet passages adapted to alternately create air swirls of opposite directions, effecting the twisting of the strands, a device for uniting the strands issuing from the swirl chambers, and a mechanism for winding the final product, in which apparatus, in accordance with the present invention, within each chamber, respective jet passages are relatively displaced longitudinally of the chamber, and that the jet passages producing the air swirls of the same direction in the adjacent swirl chambers are arranged so that one of them is situated at the inlet end of its respective swirl chamber, while the other one is situated at the outlet of its respective chamber.

With the jet passages within a swirl chamber being relatively displaced longitudinally of the chamber, the clogging of these passages is practically precluded, while the arrangement of the jet passages producing the air swirls of the same direction at the inlet and outlet ends of their respective chambers does away with the asymmetry of the lengths of the portions of the strands which are devoid of the twist, and also with the non-uniformity of the degree of the twist, which the strands acquire during the operation semi-cycles.

The herein disclosed apparatus creates indentical conditions of forming of the twisted product within the semi-cycles, which ensures complete symmetry of the twist acquired by the product during these semi-cycles and practically equal lengths of the portions devoid of the twist, whereby the strength of the yarn is increased.

In accordance with a further feature of the present invention, each swirl chamber has intermediate the jet passages a narrow portion dividing the chamber into two spaces of which one accommodates the jet passage producing the swirl of one direction, whereas the other space accommodates the jet passage producing the swirl of the opposite direction.

Within each such space the air is introduced at the portion of the space, having the greater diameter, i.e. the diameter of the swirl chamber, while the twisting of the strand is effected at the portion of the smaller diameter. In this way, the use of the air stream is more effective because the speed of the air stream increases, as the stream passes from the space of the greater diameter into the portion of the chamber having the smaller diameter, whereby each strand acquires a higher twist.

The invention is further characterized in that each swirl chamber has its portion intermediate the jet passages communicating with the ambient atmosphere. In this manner, clogging of the jet passages is positively precluded.

Thus, the herein disclosed apparatus for obtaining a twisted product improves the quality of this product, and enhances the stability and reliability of the production process.

Given hereinbelow is a detailed description of an apparatus embodying the present invention, with reference being had to the accompanying drawings, wherein.

Figure 1:
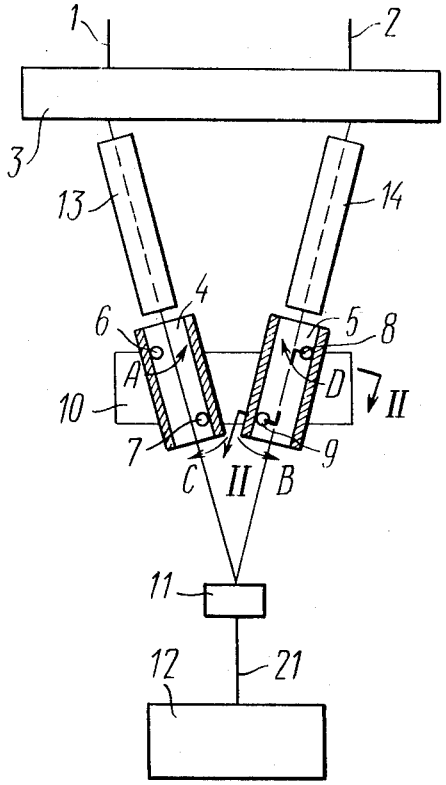
FIG. 1 is a schematic diagram of an apparatus for obtaining a self-twisted product.

Referring now to the drawings, the apparatus for obtaining a twisted product (yarn), e.g. from two strands 1 and 2 (FIG. 1) of a fibrous material, comprises: a mechanism 3 for feeding continuously the strands 1 and 2; swirl chambers 4 and 5, respectively, for treating the strands 1 and 2, having each two respective jet passages 6, 7 and 8, 9; and arrangement 10 for supplying air alternately into the jet passages 6, 7, 8 and 9; a device 11 for uniting or plying the strands 1 and 2 issuing from the chambers 4 and 5 and a mechanism 12 for winding the final product.

The mechanism 3 for continuously feeding the strands 1 and 2, the arrangement 10 for alternately supplying air into the jet passages, the device 11 for uniting the strands and the mechanism 12 for winding the final product are not described here in detail, since they can be of any or the numerous known per se structures, suitable for the purpose.

Mounted intermediate the mechanism 3 for feeding continuously the strands and the swirl chambers 4 and 5 and ejectors 13 and 14 of a known per se structure, which facilitate the feeding of the strands 1 and 2, respectively, through the chambers 4 and 5.

Figure 2:
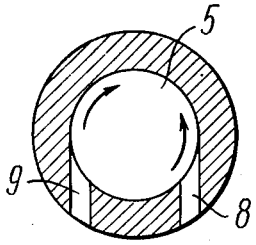
FIG. 2 is a sectional view taken along line II—II of FIG. 1.

Within each swirl chamber 4 and 5, respective jet passages 6, 7 and 8, 9 are relatively displaced longitudinally or vertically of the chamber and arranged as shown in FIG. 2, whereby the air swirls produced alternately by these jet passages are oppositely directed. In the swirl chambers 4 (FIG. 1) and 5, as well as in any other pair of adjacent swirl chambers of the plurality of chambers included in the apparatus, the jet passages 6 and 9, and also 7 and 8, producing the air swirls of the same direction are situated as shown in FIG. 1, viz. the jet passage 6 is situated at the inlet end of the swirl chamber 4, while the jet passage 9 is situated at the outlet end of the swirl chamber 5, the jet passage 7 being situated, respectively, at the outlet end of the swirl chamber 4, and the jet passage 8 at the inlet end of the swirl chamber 5.

Figure 3:
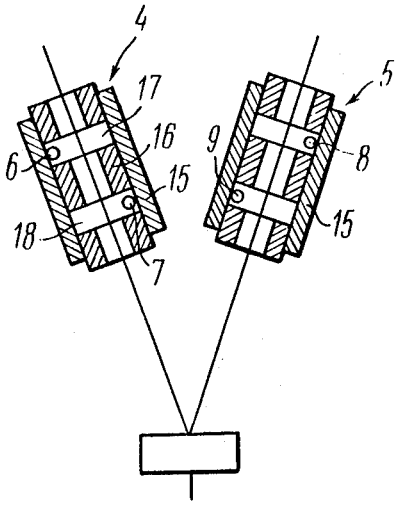
FIG. 3 illustrates a further embodiment of a swirl chamber.

The swirl chambers 4 and 5 can be structurally made each within a single housing 15, as illustrated in FIG. 3. In this embodiment, each swirl chamber has intermediate the jet passages thereof a narrow portion defined by a bush 16 dividing the chamber into two spaces 17 and 18. The space 17 thus accommodates the jet passage 6 producing an air swirl of one direction, while the space 18 accommodates the jet passage 7 producing an air swirl of the opposite direction, which steps up the effectiveness of the air swirls, i.e. the intensity of the twisting.

Figure 4:
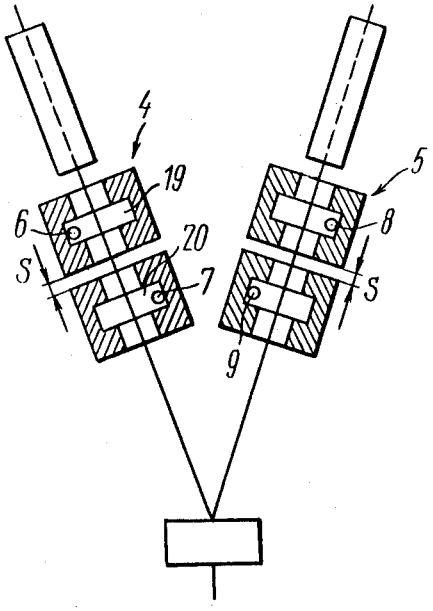
FIG. 4 illustrates another embodiment of a swirl chamber.

In accordance with another embodiment of the swirl chamber in accordance with the invention, each swirl chamber 4 and 5 (FIG. 4) has a portion thereof intermediate the jet passages communicating with the ambient atmosphere. This can be attained in various manners of which one illustrated in FIG. 4. As shown in this drawing, each swirl chamber 4 and 5 is made up of two separate parts 19 and 20 spaced from each other by a gap S equalling from 0.3 to 3.0 mm, which positively precludes the clogging of the jet passages in the course of their operation.

The herein disclosed apparatus operates, as follows.

The strands 1 (FIG. 1) and 2 are continuously fed by the mechanism 3, the ejectors 13 and 14 sending the strands through the swirl chambers 4 and 5. Within these chambers 4 and 5 the arrangement 10 and the jet passages 6, 7, 8 and 9 produce air swirls, the direction of the air swirls produced by the jet passages 6 and 9 and indicated with arrows A and B being opposite to that of the air swirls produced by the passages 7 and 8 and indicated with arrows C and D. The strands 1 and 2 which have been given the alternating twists are united or plied in the device 11, whereby they untwist about one another and thus form the self-twisted product 21 which is wound into a package by the winding mechanism 12.

The herein disclosed arrangement of the jet passages of the swirl chambers treating each pair of the united or plied strands creates identical conditions for the development of the twist during the semi-cycles of the production process, since the alternation of the lengths of the twisting zones in the individual strands would not coincide, but is staggered by a semi-cycle, which provides for the symmetry of the alternating twists in the yarn, for the same length of the portions devoid of the twist and for an increased mechanical strength of the yarn.

Furthermore, the alternation of the lengths of the twist zones in the two strands, staggered by the semi-cycle, results in some degree of a phase shift of the twists in the strands in now one, then the other strand, which yields the complete symmetry of the portions devoid of the twist and additionally strengthens the yarn being produced.

As is apparent from the drawings, the jet passages in each swirl chamber are equally displaced with respect to each other longitudinally of each chamber. In other words, a pair of planes which are normal to the central longitudinal axis of the swirl chamber 4 and which respectively contain the axes of the jet passages 6 and 7 are spaced from each other by the same distance as a pair of planes which are normal to the longitudinal central axis of the swirl chamber 5 and which respectively contain the axes of the jet passages 8 and 9. Moreover, it will be seen that a pair of mutually perpendicular planes both of which contain the longitudinal central axis of each swirl chamber and which intersect at this axis and which extend horizontally and vertically as viewed in FIG. 2 will provide an arrangement according to which both of the jet passages of each chamber are situated on one side of the plane which extends horizontally in FIG. 2 while they are situated on opposite sides of the plane which extends vertically in FIG. 2. With respect to the latter planes which contain the axis of each swirl chamber and which extend between the jet passages thereof, it will be seen that with respect to such planes in FIG. 1, the jet passages adjacent the outlet ends of the swirl chambers, namely the passages 7 and 9 in FIG. 1, are situated between these planes whereas the jet passages at the inlet ends of the chambers, namely the passages 6 and 8 of FIG. 1, are situated outside of the space between these planes. Thus, with respect to a pair of planes which respectively contain the axes of the swirl chambers and which extend between the jet passages of the swirl chamber, the jet passages at the inlet ends and the jet passages at the outlet ends of the swirl chambers form two pairs of jet passages one of which is situated between these planes and the other of which is situated outside of the space between these planes.

What is claimed is:

1. An apparatus for obtaining a self-twisted product from at least two strands, comprising: a plurality of swirl chambers, each having an inlet end and an outlet end; a mechanism for continuously feeding respective strands into said plurality of swirl chambers; at least two jet passages in each said swirl chamber, adapted to alternately produce in this chamber air swirls of opposite directions effecting the twisting of a respective strand; said jet passages in each said swirl chamber being relatively equally displaced longitudinally of this chamber; in each pair of the adjacent ones of said plurality of swirl chambers respective jet passages producing the air swirls of the same direction being arranged one at the inlet end of its respective swirl chamber and the other one at the outlet end of its respective swirl chamber; an arrangement for supplying air alternately into said jet passages to produce the air swirls; a device for uniting the strands issuing from said swirl chambers to form the product; a mechanism for winding this product.

2. An apparatus as claimed in claim 1, wherein each swirl chamber has intermediate respective jet passages thereof a narrow portion dividing said chamber into two spaces each of which is of a diameter greater than the diameter of said narrow portion, one such space accommodating the jet passage producing the air swirl of one direction, and the other such space accommodating the jet passage for producing the air swirl of the opposite direction.

3. An apparatus as claimed in claim 1 wherein each swirl chamber has a portion thereof intermediate said jet passages communicating with the ambient atmosphere at a location intermediate said jet passages.

4. An apparatus as claimed in claim 2, wherein each swirl chamber has a portion thereof intermediate said jet passages communicating with the ambient atmosphere at a location intermediate to the said jet passages.

5. An apparatus as claimed in claim 1, wherein the jet passages respectively situated at the inlet ends of said swirl chambers form a first pair of jet passages while the jet passages respectively situated at the outlet ends of said swirl chambers form a second pair of jet passages, and said first and second pairs of jet passages having with respect to planes containing the longitudinal central axes of the swirl chambers and extending between the jet passages of each swirl chamber a relationship according to which one of said pairs of jet passages is situated between said planes while the other of said pairs of jet passages is situated outside of the space between said planes.

6. An apparatus as claimed in claim 5, wherein said second pair of jet passages are situated between said planes.

7. An apparatus as claimed in claim 5, wherein the jet passages of each swirl chamber are situated on the same side of a second plane which is perpendicular to the plane extending between the latter jet passages and which contains the longitudinal central axis of the swirl chamber.

* * * * *